US005652826A

United States Patent [19]

Mills

[11] Patent Number: 5,652,826

[45] **Date of Patent: *Jul. 29, 1997**

[54] RADIANT ELECTRIC SPACE HEATER WITH CAPILLARY TUBE THERMOSTAT

[75] Inventor: Thomas H. Mills, Urbana, Ohio

[73] Assignee: The W. B. Marvin Manufacturing Company, Urbana, Ohio

[ * ] Notice: The term of this patent shall not extend beyond the expiration date of Pat. No. 5,381,509.

[21] Appl. No.: 369,927

[22] Filed: Jan. 6, 1995

Related U.S. Application Data

[63] Continuation of Ser. No. 55,712, Apr. 28, 1993, Pat. No. 5,381,509.

[51] Int. Cl.[6] ..... F24H 3/04

[52] U.S. Cl. ..... 392/376; 392/360

[58] Field of Search ..... 392/360, 361, 392/363–370, 373, 375–385, 352, 353

[56] References Cited

U.S. PATENT DOCUMENTS

| | | | |
|---|---|---|---|
| 541,204 | 6/1895 | Hallenbeck | 454/332 |
| 1,410,280 | 3/1922 | Wolff | 126/92 B |
| 1,429,085 | 9/1922 | McGary . | |
| 2,234,373 | 3/1941 | Gough . | |
| 2,261,392 | 11/1941 | Riendeau | 312/213 |
| 2,329,568 | 9/1943 | Wallance | 312/213 |
| 2,329,592 | 9/1943 | Clemons . | |
| 2,491,399 | 12/1949 | Thompson . | |
| 2,658,666 | 11/1953 | Krzesiewski | 416/247 R |
| 2,707,745 | 5/1955 | Farr . | |
| 2,852,657 | 9/1958 | Markel . | |
| 2,896,526 | 7/1959 | Wilson | 454/332 |
| 3,051,820 | 8/1962 | Krichton . | |
| 3,433,929 | 3/1969 | Snelling . | |
| 3,538,031 | 11/1970 | Birdwell . | |
| 3,679,868 | 7/1972 | England | 392/353 |

(List continued on next page.)

FOREIGN PATENT DOCUMENTS

| | | | |
|---|---|---|---|
| 462127 | 1/1914 | France | 312/213 |
| 2343286 | 11/1977 | France . | |
| 2494406 | 5/1982 | France | 392/377 |
| 699587 | 11/1953 | United Kingdom | 312/328 |
| 1299865 | 12/1972 | United Kingdom | 126/89 |

OTHER PUBLICATIONS

English language translation of FR 2,343,236.

Advertising brochure, *Practical Features Make Quartz Modular Heaters Your Number One Choice,* published by Tanson, Quartzheat Division, West Midlands, Great Britain prior to Apr. 28, 1993.

Advertisement, *Marvin Fan Forced Electric Heaters,* published Jun. 1991 by The W. B. Marvin Manufacturing Co., Urbana, Ohio.

Advertisement, *10H Series Linear Limit Thermostat,* published by Thermo–O–Disc, Inc., Mansfield Ohio , and admitted to be prior art.

Advertisement, *Fan Forced Electric Heaters,* published Jul. 1992 by The W. B. Marvin Manufacturing Co., Urbana, Ohio.

Owner's Guide For Crestline Heater Published During the 1980's.

Carton for Crestline Heater Shown in Four Photographs and Used during the 1980's.

7 Photographs of a Crestline Model 4940–Q Heater.

Owner's Guide for a Crestline 4940 Heater Included with the Heater of Reference AR[1].

3 Photographs of the Carton in Which the Reference AR[1] Heater is Believed to have been Packaged.

*Primary Examiner*—Tu B. Hoang

*Attorney, Agent, or Firm*—Roger S. Dybvig; John J. Cheek

[57] ABSTRACT

A radiant electric space heater is provided with a high heat limiting capillary tube thermostat and with a grill which is pivotally mounted so that it may be pivoted to an out-of-the-way position for cleaning. The capillary tube thermostat extends along a wire forming part of the grill and into the housing of the heater.

7 Claims, 2 Drawing Sheets

U.S. PATENT DOCUMENTS

| | | | |
|---|---|---|---|
| 3,727,537 | 4/1973 | Harty . | |
| 3,731,057 | 5/1973 | Kunz et al. | 392/368 |
| 3,731,247 | 5/1973 | Levinn . | |
| 4,022,548 | 5/1977 | McLarty | 416/247 R |
| 4,273,990 | 6/1981 | Steiner et al. . | |
| 4,700,051 | 10/1987 | Goessler . | |
| 5,176,570 | 1/1993 | Liedl . | |
| 5,348,447 | 9/1994 | Redetzke | 416/247 R |
| 5,381,509 | 1/1995 | Mills | 392/376 |

RADIANT ELECTRIC SPACE HEATER WITH CAPILLARY TUBE THERMOSTAT

CROSS-REFERENCE TO RELATED APPLICATIONS

This is a continuation of application Ser. No. 08/055,712, filed Apr. 28, 1993, now U.S. Pat. No. 5,381,509.

FIELD OF THE INVENTION

This invention relates to a radiant electric space heater and, although not so limited, this invention is particularly directed to a portable horizontal radiant electric space heater for household use.

BACKGROUND OF THE INVENTION

Portable horizontal space heaters, i.e. those which have a relatively low profile, are shown in U.S. Pat. No. 3,175,550, issued to R. S. Knapp on Mar. 30, 1965, U.S. Pat. No. 3,059,090, granted to R. S. Waters on Oct. 16, 1962, and U.S. Pat. No. 3,610,882, issued to W. A. Omohundra on Oct. 5, 1971. In addition, there are several different models of portable horizontal space heaters currently being marketed in the United States.

A typical portable space heater on the market today has a user-adjustable thermostat used to detect the ambient temperature or, more precisely, the temperature of a portion of the heater that bears a reasonably constant relation to the ambient temperature. In addition, it is also a common practice to provide a portable space heater with a high temperature limiting device, usually in the form of a non-adjustable, or else a factory-adjustable, thermostat. An important purpose of a high temperature limiting device is to avoid the risk of fire due to certain abnormal conditions in which a heater may be used. An overheated portable heater may also cause personal injury from excessive heat or electric shock.

One cause of overheating is the placement of the heater heating elements so close to another object that the object is excessively heated. This could occur, for example, when a heater which is to be placed with its back close to a wall is instead placed with its front close to the wall. It could also occur when a heater is tipped over on its front face. Another problem which is considered to be an overheating problem is the risk of fire created when a piece of flammable fabric or other flammable material is draped over the front of a heater.

Many of the circumstances which can cause overheating can be handled by temperature sensors placed in essentially any location in front of the heating elements. However, some causes of overheating require more sophisticated approaches. For example, Underwriter's Laboratories, Inc. (UL) has a requirement that portable space heaters must meet certain so-called "drape" test criteria in which a piece of fabric material draped over only parts of the front of the heater will not catch on fire. To meet some drape tests, it is necessary to provide a high temperature limiting detector or detectors capable of detecting localized hot spots that may be created at different locations in the front of the heater. Plural overheat detectors have been used in an effort to meet these tests, but the use of plural detectors does not provide assurance against the formation of localized hot spots.

Therefore, there is a need for an improved heater which can provide adequate protection against overheating in the event it is operated under certain abnormal conditions, particularly when the heating element or elements are too close to other objects, and particularly when the other objects are too close to only a portion of the front of the heater so that any overheating is localized.

Capillary tube thermostats have been used for many years in baseboard heaters because they are capable of detecting localized hot spots over substantially the entire lengths of sections of the baseboard heaters. However, in so far as known, capillary tube thermostats have not been used in radiant heaters since they are not readily heated by radiant heat energy.

A problem experienced with conventional radiant electric space heaters is that their heating chambers, being open to the outside of the heater, often get quite dirty after extended use. Accordingly, it would be desirable to enable one to clean the heating chamber. However, the grills used to cover the windows to the heating chambers, the presence of which prevents thorough cleaning of the heating chambers, are, for purposes of safety, normally difficult or impossible to remove.

SUMMARY OF THE INVENTION

An object of this invention is to provide an improved thermostatic control for a radiant electric space heater. Another object of this invention is to provide such an improved control which is readily adopted to mass production of heaters and is reasonably inexpensive.

In accordance with this invention, a radiant electric space heater is provided that has a housing having a front wall with a heat-transmitting window, a reflector assembly mounted within the housing and forming a heating chamber open to the window. One or more electrically operated, radiant heating elements are located within the heating chamber. Operation of the heating elements is controlled in part by a high temperature limiting capillary tube thermostat having a capillary tube sensor extending across the heating chamber. The capillary tube senser is not heated to trigger an open circuit directly by the radiant heating element or elements. However, localized hot spots created by the diversion of the path of a naturally occurring stream of convectively-heated air onto the sensor will cause the sensor to be heated to the point that the capillary tube thermostat opens the heater circuit.

Further in accordance with this invention, the capillary tube sensor has a section extending through a portion of the housing outside the heating chamber so that it can detect overheating conditions in the housing outside the heating chamber.

The heater preferably, but optionally, has a fan which draws ambient air into the housing to cool the housing. In accordance with another aspect of this invention, the reflector assembly is sufficiently imperforate that the operation of the fan does not create a forced air flow in the heating chamber which would interfere with naturally occurring convectively-heated air flow in the heating chamber.

In another aspect, an object of this invention is to provide a radiant electric heater which is easier to clean than prior conventional heaters. More specifically, an object of this invention is to provide a radiant electric heater having a grill which can be moved to an out-of-the-way position to permit cleaning of the heating chamber. This is accomplished in accordance with the presently preferred embodiment of this invention by pivotally mounting a rod or grill wire located near one edge of the grill in mutually spaced, aligned apertures in the reflector assembly and affixing the opposite edge of the grill to the heater housing with a suitable fastener that can be quickly removed. Accordingly, one may remove the fastener and pivot the grill to an out-of-the-way orientation to enable the heating chamber to be cleaned without substantial interference from the grill. Advantageously, the grill is not readily removed so that it should be returned to its proper orientation after the task of cleaning the heater is completed.

Still another object of this invention is to provide a radiant electric heater with both a capillary tube thermostat and a pivotal grill wherein the grill may be pivoted for cleaning purposes without changing the location of, or bending, the capillary tube sensor part of the thermostat. To this end, the portion of the capillary tube sensor within the heating chamber lies along the side of the grill wire used to pivotally mount the grill, and the capillary tube sensor and the ends of the grill wire extend through the same holes in the reflector.

Other objects and advantages will become apparent from the following description and the drawings.

DETAILED DESCRIPTION

Figure 1:
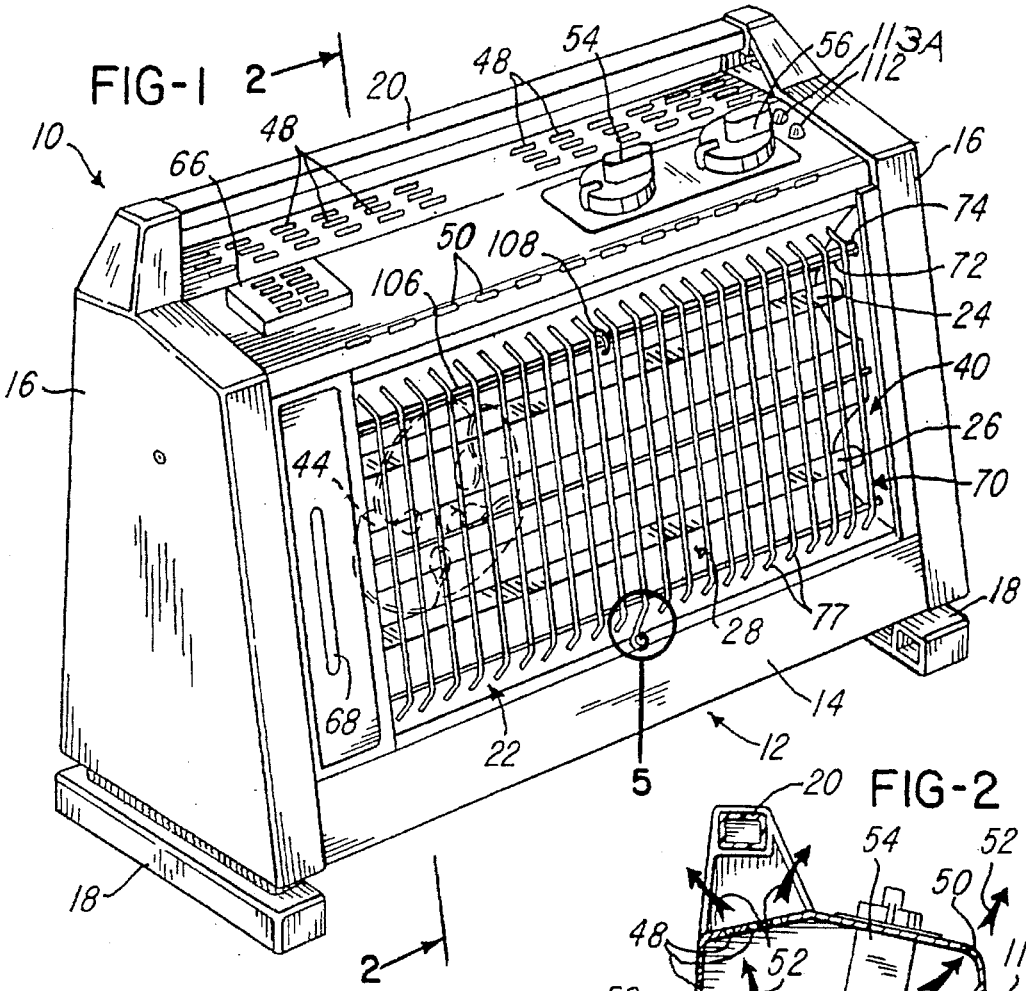
FIG. 1 is a perspective view of a space heater in accordance with this invention.
Figure 2:
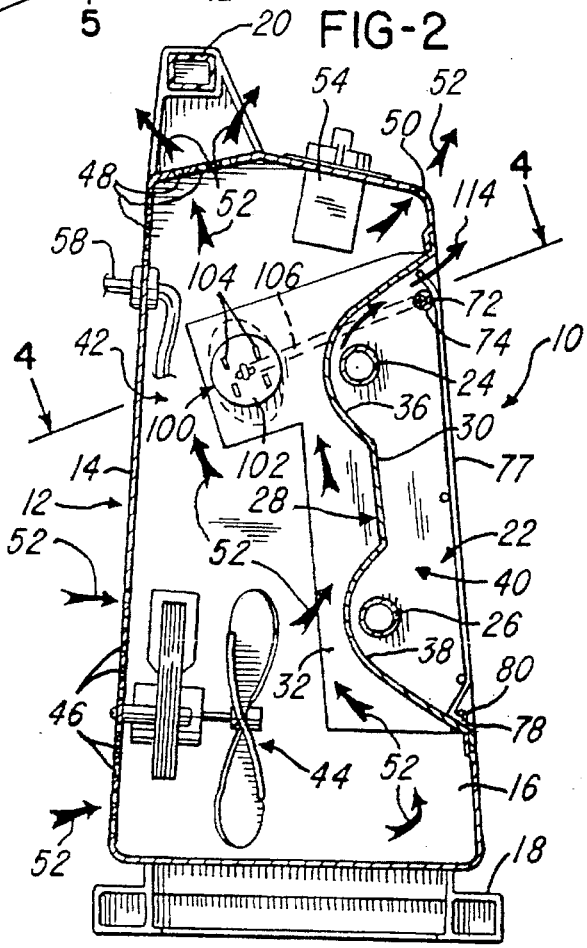
FIG. 2 is a slightly enlarged cross-sectional view taken along line 2—2 of FIG. 1.

With reference to FIGS. 1 and 2, this invention is shown embodied in a portable horizontal radiant electric space heater, generally designated 10, comprising a housing, generally designated 12, formed from a central casing 14 to which a pair of end walls 16 are connected by suitable fasteners (not shown). End walls 16 have elongate supporting feet 18 and also preferably provide a support for a handle bar 20 that extends over the top of the casing 14.

Almost the entire front of the casing 14 provides a large, rectangular window 22 communicating between the inside and the outside of the housing 12 so that radiant heat energy can be transmitted from a pair of radiant heating elements, namely an upper element 24 and a lower element 26, and from a reflector assembly, generally designated 28. Heating elements 24 and 26, which are of the type known as "quartz" heating elements, are shown in simplified form in the drawings. As known in the art, these each comprise a length of coiled resistance wire (not shown) positioned in a high quality glass or so-called "quartz" tube. Reflector assembly 28 includes a reflector panel 30 and spaced sidewalls 32 and 34. The reflector panel 30 has a heat reflective surface facing the heat-transmitting window 22 and the sidewalls 32 and 34 have heat reflective surfaces facing one another. In elevation, the reflector panel 30 is substantially coextensive with the window 22 and the illustrated reflector panel 30 has elongate parabolic sections 36 and 38 behind the heating elements 24 and 26, respectively. The parabolic sections 36 and 38 are provided to focus the radiant heat reflected thereby to a relatively restricted area. However, it should be noted that the invention described below may be used with heaters having other types of heating elements, e.g. simple wrapped or else coiled resistance wire heating elements, and having different forms of reflector panels, including essentially planar reflector panels.

Reflector assembly 28, which is connected to the inside surface of the casing 14 surrounding the window 22, separates the housing 12 into two chambers, namely a radiant heating chamber 40, through which the heating elements 24 and 26 extend, and an inner housing chamber 42. An electrically-operated cooling fan 44 is mounted within the inner housing chamber 42 and is used to draw cooling, ambient air, indicated by solid arrows 52, into the inner housing chamber and circulate the air within the inner housing chamber 42 and forces the circulating air to exit through plural apertures 48 on the top rear of the casing 14 and other apertures 50 in the top front of the casing 14 Just above the top of the window 22.

The inner housing chamber 42 also provides a housing for heater controls including a user-adjustable thermostat 54 and a heater switch 56. Only the control knob of the heater switch 56 can be seen in the FIG. 2, the body of the switch 56 being hidden by the body of the thermostat 54 in FIG. 2. The source of electrical power to the heater 10 is indicated by a power cord 58 in FIG. 2.

Figure 4:
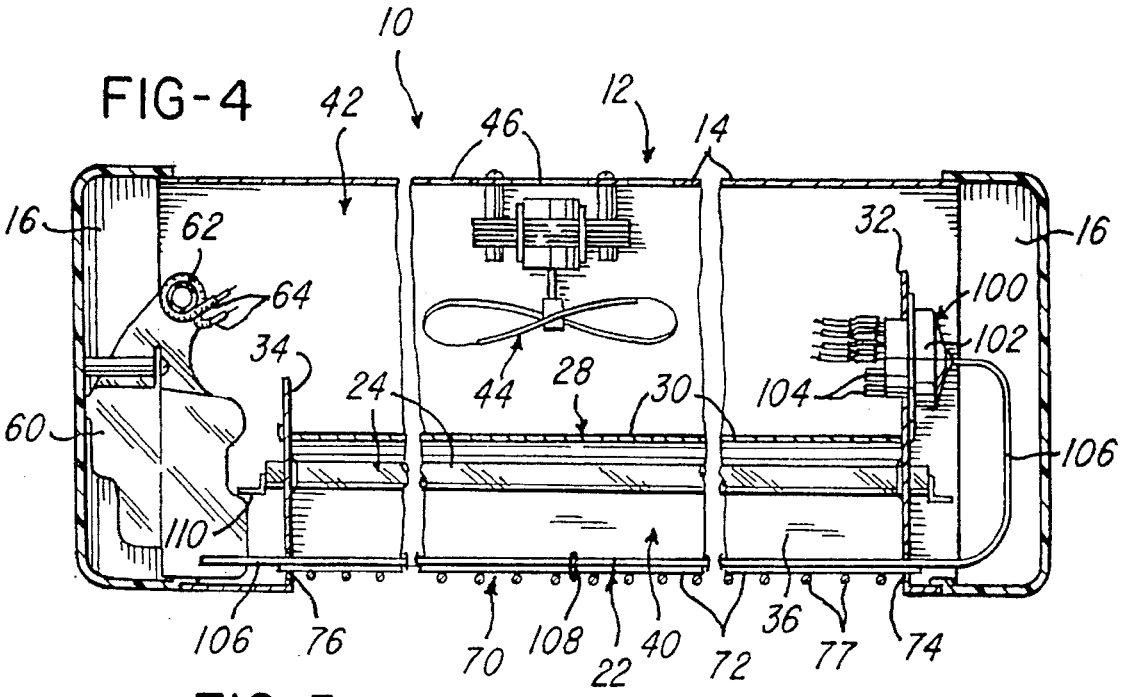
FIG. 4 is a cross-sectional view of the heater on approximately the same scale as FIG. 2 and taken along line 4—4 thereof.

With reference to FIG. 4, the heater 10 is provided with a steam-generating humidifier comprising a water bottle 60 and a vaporizer tube 62 partially wrapped by a resistance wire heater 64. The bottle 60 may be filled through a port 66 (FIG. 1) in the top wall of the casing 14, and the water level within the bottle 60 may be viewed through a window 68. Steam generated within the vaporizer tube 62 will exit through the fill port 66 into the surrounding area. The provision of a humidifier is entirely optional and is not part of the present invention.

Figure 5:
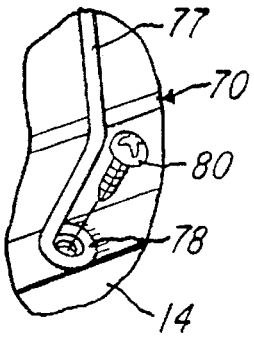
FIG. 5 is a partially-exploded, fragmentary perspective view of the portion of the heater within the circle 5 of FIG. 1.

A protective grill 70 covers the window 22. Preferably, the grill 70 includes a horizontal grill or cross wire 72 which has ends extending through aligned apertures 74 (FIGS. 1 through 4) and 76 (FIG. 4) in the reflector sidewalls 32 and 34, respectively. Also, the grill 70 may include plural vertical grill wires 77 including one located near the center of the window 22 that has a screw eye 78 (shown best in FIG. 5) formed at its bottom end through which a screw 80 extends. With this construction, the screw 80 may be unscrewed to enable one to lift the bottom of the grill and pivot it about the axis of the cross wire 72, thereby providing access to the heating chamber for purposes of cleaning the heating chamber 40 and particularly the reflective surfaces of the reflector assembly 28.

With reference to FIGS. 1 through 4, in the event of a failure of the user-adjustable thermostat 54, an overheating of the heater 10 is prevented by use of a temperature limiting, capillary tube thermostat, generally designated 100, comprising a switch housing 102, switch terminals 104, and a capillary tube heat sensor 106. The temperature limiting thermostat 100 may be conventional, an example being an Automatic Reset Type 10H11 Linear Limit Thermostat which is available from Therm-O-Disc, Incorporated, 1320 South Main Street, Mansfield, Ohio 44907-0538. The settings of the thermostat 100 will depend upon the various criteria. One such device, Model No. 221140, which is set so that its contacts open at 262±10 degrees F. and close at 222+20 degrees F., −25 degrees F. have been successfully used in a portable household heater having the configuration of the heater 10 of this invention.

Figure 3:
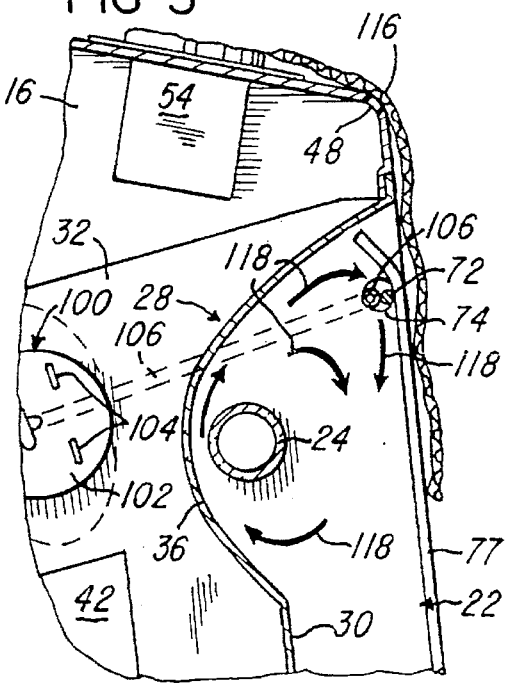
FIG. 3 is an enlarged fragmentary, cross-sectional view of a portion of the heater shown in FIG. 2 along with a cross-sectional view of a portion of a piece of fabric draped over the front of the heater.

As shown in FIGS. 2 through 4, the thermostat switch housing 102 is mounted on a rearwardly extending portion of the right reflector sidewall 32 and the capillary tube sensor 106 projects outwardly from the thermostat switch housing 102 to the right side of the right reflector sidewall 32 into an open area of the inner housing chamber 42, and extends generally parallel to the right reflector sidewall 32 forwardly toward the front of the housing 12, and then through the aperture 74 in the right reflector sidewall 32, along the entire width of window 22, and then through the aperture 76 in the left sidewall 34 to a point of termination in an open area of the inner housing chamber 42 on the left side of the left sidewall 34. Conveniently, the section of the capillary tube sensor 106 spanning across the window 22 extends alongside the cross wire 72. Also, the center part of the capillary tube sensor 106 is preferably supported by a connecting wire loop 108 coiled about the sensor 106 and the cross wire 72. The loop 108 and the apertures 74 and 76 in the reflector sidewalls 32 and 34 are of sufficient diameter that the grill 70 may be pivoted for purposes of cleaning without moving or bending the capillary tube sensor 106.

Figure 6:
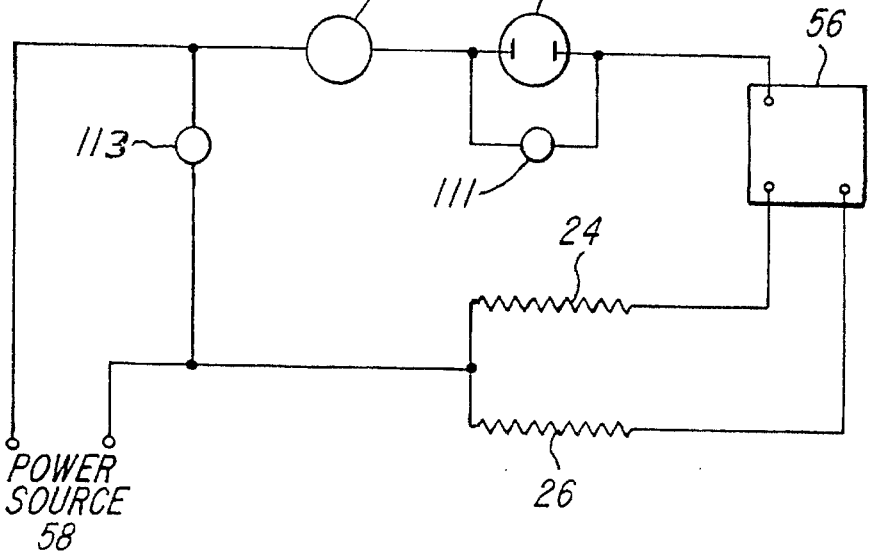
FIG. 6 is a simplified schematic electric circuit diagram illustrating the connections of the thermostats with the heating elements of the heater of FIGS. 1 through 5.

With reference to FIGS. 4 and 6, and as will be readily understood by those familiar with the art, the user adjustable thermostat 54 and the temperature limiting thermostat 100 are connected in electrical series relation between the power source 58 and the switch 56. Accordingly, if the switch contacts of the temperature limiting thermostat 100 are open circuited because of excessive heat detected by the capillary tube sensor 106, power to the heating elements 24 and 26 will be interrupted and will remain interrupted until the temperature of the sensor 106 drops below a predetermined level. During this interval, a warning light 111 (FIG. 6) will preferably be visible through a red-colored translucent lens 112 (FIG. 1) on the top wall of the housing 12 to warn the user that an unsafe condition has caused the triggering of the temperature limiting thermostat 100. FIG. 6 also shows an indicator light 113 which is visible through a lens 113A (FIG. 1) used to indicate that the heater is plugged into house current.

A comparison of FIGS. 2 and 3 will demonstrate one way in which the capillary tube sensor 106 may be exposed to excessive heat. Line arrows 114 (FIG. 2) indicate the direction of a naturally induced flow of convectively-heated air. In FIG. 2, which illustrates a normal, safe operating condition, the naturally occurring upwardly flowing stream of heated air is channeled by the configuration of the reflector assembly 28 out of the top of the reflector above the capillary tube sensor 106. Accordingly, the capillary tube sensor 106 is not heated to any appreciable extent by convection. It is also not heated to a high level by radiant energy due to its small diameter. Heating by conduction is probably insignificant. Accordingly, under any normal operating conditions, the capillary tube sensor 106 is not subjected to high levels of heat.

In FIG. 3, a piece of fabric 116 is shown draped over the top and the front of the heater 10. If the heater 10 continued to operate under this condition, the exposure of the fabric to both radiant heat energy and convectively-heated air could cause the fabric piece 116 to ignite. However, the fabric piece 116 causes the naturally occurring air stream to flow in an abnormal path, as indicated by line arrows 118 in FIG. 3, causing the air stream to impinge on the capillary tube sensor 106 and heat part of it to the extent that the switch contacts within the thermostat housing 102 open, thereby disrupting operation of the heating elements 24 and 26. During this time, the warning light 111 indicative of the operation of the temperature limiting thermostat 100 is energized and visible through the red lens 112. It may be noted that a well-known attribute of capillary tube thermostats is their ability to detect isolated areas of high heat or so-called "hot spots." A piece of fabric draped over only a relatively small portion of the total width of the window 22 will create a hot spot which will cause the capillary tube thermostat 100 to respond to its presence.

Other unsafe conditions that subject the capillary tube sensor 106 to a convectively-heated air flow are the placement of the heater 10 too close to a vertical wall and the tipping over of the heater 10 on its front face. Although a tip-over switch, if provided, will normally act to turn off the heater immediately if it tips over, the capillary tube thermostat of this invention provides a back-up for the tip-over switch and may permit the use of less expensive tip-over switches.

Although the temperature limiting thermostat 100 is provided primarily to discontinue heater operation when the front of the heater is too close to surrounding objects, or when the window 22 is covered or partially covered, other abnormal conditions may cause the capillary tube sensor 106 to overheat. In the absence of another abnormal condition, the heater 10 will not overheat even if the user adjustable thermostat 54 fails in a switch-closed condition, because the cooling fan 44 will continue to cool the housing 12. However, if the cooling fan 44 should also fail to operate, there is a possibility that the housing 12 would become excessively hot. This condition may be mitigated by an opening of the temperature limiting thermostat switch in the event that the temperature within the inner housing chamber 42 elevates to a dangerously high level. Thus, the section of the capillary tube sensor 106 within the inner housing chamber 42 will be subjected to convectively (and conductively) heated air and may cause the temperature limiting thermostat 100 to disrupt power to the heating elements 24 and 26.

The optimal vertical location of the capillary tube sensor 106 relative to the top and bottom of the window 22 across the open window 22 will depend upon the shape and size of the reflector assembly 28. In general, the temperature limiting thermostat 100 will open circuit too frequently if the capillary tube sensor 106 is located close to the top of the reflector in an area of a high concentration of the normally created flow of convectively-heated air. The temperature limiting thermostat 100 may take too long to open circuit if it is located so far from the top of the window 22 that an abnormally created convectively-heated air flow does not reach the capillary tube sensor 106. Therefore, the vertical location of the capillary tube sensor 106 will usually have to be determined by trial and error.

Electric heater control circuits having user adjustable thermostats and temperature limiting thermostats connected in series are in common use. Except for the use of the capillary tube thermostat 100 as employed in this invention, the heater control circuit used for the heater 10 of this invention may be the same as the prior art circuits. Since the circuit does not form part of this invention and may be essentially conventional, it is only partly shown in FIG. 6 and is not further illustrated or described herein.

Prior art electric radiant space heaters typically have air vents through their radiant heat reflectors through which fan-forced air flows during operation. The heater 10 of this invention does not have such air vents because fan-forced air flowing through the reflector would interfere with the flow patterns of the naturally occurring convectively-heated air and cause improper operation of the temperature limiting thermostat.

Although the presently preferred embodiment of this invention has been described, it will be understood that within the purview of the invention various changes may be made within the scope of the following claims.

Having thus described my invention, I claim:

1. An electric space heater comprising:

a housing having a front wall and a heat-transmitting window in said front wall;

a reflector assembly mounted within said housing and forming with said housing a heating chamber open to said window, said reflector assembly dividing said housing into two chambers, namely said heating chamber and an inner housing chamber;

said reflector assembly having heat reflective surface portions facing said window;

a source of electrical power;

an electrically operated radiant heating element connected to said power source, said heating element being located in said housing between said reflective surface portions and said window; and a capillary tube thermostat having terminals electrically connected between said source and said heating element, said thermostat having a capillary tube sensor within said housing extending across said heating chamber window, said capillary tube sensor having a section located within said inner housing chamber that will detect overheating conditions therein.

2. The heater of claim 1 further comprising a fan for cooling said housing located within said inner housing chamber that, when properly operating, prevents overheating of said housing.

3. The heater of claim 2 wherein said housing has openings that admit air at ambient temperature into said inner housing chamber and other openings that exhaust fan-forced air from said inner housing chamber, and said reflector assembly is sufficiently imperforate that the operation of said fan will not create significant forced air flow in said heating chamber which would interfere with naturally occurring convective air flow in said heating chamber.

4. An electric space heater comprising:

a housing having a front wall and a heat-transmitting window in said front wall;

a reflector assembly mounted within said housing and forming with said housing a heating chamber open to said window;

said reflector assembly having heat reflective surface portions facing said window;

a source of electrical power;

an electrically operated radiant heating element connected to said power source, said heating element being located in said housing between said reflective surface portions and said window;

a capillary tube thermostat having terminals electrically connected between said source and said heating element, said thermostat having a capillary tube sensor within said housing extending across said heating chamber window; and a grill mounted on said housing within said window, said capillary tube sensor extending across said window adjacent said grill, an intermediate portion of said capillary tube sensor being connected to said grill.

5. The heater of claim 4 wherein said grill includes a cross wire spanning said window and extending into a pair of mutually confronting apertures in said reflector assembly located behind respectively opposite sides of said window, and wherein said capillary tube sensor also extends through said apertures.

6. An electric space heater comprising:

a housing having a front wall and a heat-transmitting window in said front wall;

a reflector assembly mounted within said housing and forming with said housing a heating chamber open to said window;

said reflector assembly having heat reflective surface portions facing said window;

a grill covering said window that includes a wire spanning said window and extending into a pair of mutually confronting apertures in said reflector assembly located behind respectively opposite margins of said window a source of electrical power;

an electrically operated radiant heating assembly connected to said power source, said heating assembly including a heating element located in said housing between said reflective surface portions and said window, operation of said radiant heating assembly creating in said heating chamber a naturally occurring stream of convectively-heated air; and a capillary tube thermostat having terminals electrically connected between said source and said heating element, said thermostat having a capillary tube sensor within said housing extending across said heating chamber window adjacent said grill in a position in which it will cause deenergization of said heating assembly in the event an outside influence causes said stream of air to impinge upon said sensor.

7. An electric space heater comprising:

a housing having a front wall and a heat-transmitting window in said front wall;

a reflector assembly mounted within said housing and forming with said housing a heating chamber open to said window;

said reflector assembly having heat reflective surface portions facing said window;

a grill covering said window that includes a wire spanning said window and extending into a pair of mutually confronting apertures in said reflector assembly located behind respectively opposite margins of said window;

a source of electrical power;

an electrically operated radiant heating assembly connected to said power source, said heating assembly including a heating element located in said housing between said reflective surface portions and said window, operation of said heating assembly creating in said heating chamber a naturally occurring stream of convectively-heated air; and a capillary tube thermostat having terminals electrically connected between said source and said heating element, said thermostat having a capillary tube sensor within said housing extending across said heating chamber window adjacent said grill in a position in which it will cause deenergization of said heating assembly in the event an outside influence causes said stream of air to impinge upon said sensor;

wherein said capillary tube sensor also extends through said apertures.

* * * * *